US007705546B2

(12) United States Patent
Juen

(10) Patent No.: US 7,705,546 B2
(45) Date of Patent: Apr. 27, 2010

(54) INTERFACE FOR LAMP OPERATING UNITS WITH LOW STANDBY LOSSES

(75) Inventor: Reinhold Juen, Dornbirn (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 0 days.

(21) Appl. No.: 10/563,092

(22) PCT Filed: Jun. 23, 2004

(86) PCT No.: PCT/EP2004/006793

§ 371 (c)(1),
(2), (4) Date: Jan. 16, 2007

(87) PCT Pub. No.: WO2005/004552

PCT Pub. Date: Jan. 13, 2005

(65) Prior Publication Data

US 2007/0138974 A1 Jun. 21, 2007

(30) Foreign Application Priority Data

Jul. 2, 2003 (DE) ..... 103 29 876

(51) Int. Cl.
*G05F 1/00* (2006.01)

(52) U.S. Cl. ..... 315/307; 315/360; 315/362; 315/312; 379/93.05; 379/93.08; 379/379

(58) Field of Classification Search ..... 315/291–297, 315/209 R, 307, 276, 360, 362, 312; 379/93.05–93.08, 379/379, 413
See application file for complete search history.

(56) References Cited

U.S. PATENT DOCUMENTS

| | | | | |
|---|---|---|---|---|
| 4,656,475 | A | 4/1987 | Miller et al. | 340/825.06 |
| 4,691,341 | A | 9/1987 | Knoble et al. | 379/97 |
| 6,081,586 | A * | 6/2000 | Rahamim et al. | 379/93.29 |
| 6,297,724 | B1 | 10/2001 | Bryans et al. | 340/3.51 |

(Continued)

FOREIGN PATENT DOCUMENTS

DE 197 57 295 9/1998

(Continued)

OTHER PUBLICATIONS

DALI Manual. Digital Addressable Lighting Interface Activity Group, ZVEI-Division Luminaries. AG DALI, pp. 19, 21. 2001.

*Primary Examiner*—Haissa Philogene
(74) *Attorney, Agent, or Firm*—Fitzpatrick, Cella, Harper & Scinto

(57) ABSTRACT

An interface (12) for a lamp operating device (13) has two input-side terminals (1, 2) for the connection of bus lines or for connection with a button or switch, an evaluation logic (3) for the processing of signals present at the input-side terminals (1, 2) and for the generation of output-side signals for the control of the lamp operating device (3), and at least one electrical isolation element (4) to electrically decouple the input-side terminals (1, 2) from the lamp operating device (13). Thereby, the evaluation logic (3) is arranged on that side of the electrical isolation element (4) which is towards the input-side terminals (1, 2), and is supplied with voltage via the input-side terminals (1, 2) of the interface (12).

18 Claims, 3 Drawing Sheets

U.S. PATENT DOCUMENTS 6,388,399 B1 * 5/2002 Eckel et al. ..... 315/312
6,762,570 B1 * 7/2004 Fosler ..... 315/312
6,771,029 B2 * 8/2004 Ribarich et al. ..... 315/292
7,042,173 B2 * 5/2006 Huber ..... 315/318
7,259,528 B2 * 8/2007 Pilz ..... 315/294
7,466,084 B2 * 12/2008 Juen ..... 315/224
2002/0175637 A1 11/2002 Wilhelm ..... 315/224
2005/0179404 A1 * 8/2005 Veskovic et al. ..... 315/291

FOREIGN PATENT DOCUMENTS

GB 2 368 169 A 4/2002
WO 02/082618 10/2002

* cited by examiner

INTERFACE FOR LAMP OPERATING UNITS WITH LOW STANDBY LOSSES

This application is a national stage application under 35 U.S.C. 371 of PCT/EP2004/006793, filed Jun. 23, 2004, which is incorporated by reference.

FIELD OF THE INVENTION

The present invention relates generally to interfaces for lamp operating devices, such as for example electronic ballasts for gas discharge lamps. The invention relates further to lamp operating devices having such interfaces, and to methods for the control of a lamp operating device by means of an interface.

BACKGROUND OF THE INVENTION

By means of such interfaces it is possible to transmit to a lamp operating device signals from a bus or from a button or switch connected with the mains voltage. Thereby there is usually provided in the interface an evaluation logic which transforms the digital or analog signals present at the inputs of the interface into control signals for the lamp operating device. The signals delivered to the interface may represent commands (desired values for setting values etc.) but also condition-related information. In particular if a bi-directional interface is provided, condition information from the lamp operating device can be transmitted to a bus connected at the interface.

Such interfaces are employed for example in the context of the so-called DALI (Digital Adressable Lightening Interface) industry standard.

From DE 197 57 295 A1 (see there FIG. 7) there is known an example for an interface to which there can be selectively applied signals from a button/switch or rather digital signals from a bus. In the case of a connected button, a connected electronic ballast can then for example be switched on or switched off by means of a pressing of the button. Further, by means of an appropriate temporal duration of the pressure actuation of the button a desired value for a brightness regulation can be attained, since the connected evaluation logic of the interface transforms the duration of the pressure actuation of button into a desired value signal for the electronic ballast (EVG).

As is schematically illustrated in FIG. 6, there is provided between the input-side terminals 1, 2 of such an interface 12 and the operating device 13 for one or more lamps 14, an electrical isolation element 4, such as for example an optocoupler. The digital signals, for example, delivered from a bus, are transmitted via this electrical isolation element to the evaluation logic 3, which thus, seen from the bus, is located behind the electrical isolation element 4. Since on the other hand, the evaluation logic 3 must react immediately to incoming signals from the terminals of the interface, with the state of the art there is the problem that the lamp operating device can never be completely switched off, since otherwise also the evaluation logic would be switched off. The evaluation logic must thus be continuously supplied with mains voltage 15, which manifests itself in corresponding stand-by losses (power which is used in stand-by operation).

FIG. 7 shows schematically how the current/voltage supply 27 for the evaluation logic 3 in the ballast 13 resorts to the mains supply 15 of the ballast 13 by means of an AC/DC converter 16. Further, there can be seen also schematically in the ballast 13, the inverter 17, the output driver for the lamp(s) 4 and the lamp control/regulation 19 communicating bi-directionally with the evaluation logic 3.

The stand-by losses stand in contradication to the enormous efforts which have been undertaken in recent times in the matter of energy saving in lamp technology. As an example WO 02/082618 A1 is mentioned, which shows a possibility for reducing the stand-by losses in the case of a DALI interface. In accordance with this state of the art, a DALI processor is put into a stand-by mode when no signals are transmitted on the connected DALI bus. Further, FIG. 3 of WO 02/082618 A1 shows an example for the generally prevailing trend that the evaluation logic, seen from the DALI bus, must be arranged behind the electrical isolation element (isolation 310 in FIG. 3).

From U.S. Pat. No. 6,388,399 there is known a control system for the control of a plurality of consuming units arranged in a distributed manner, in which control units are provided for the control of the consuming units associated with them. The possibility of brightness control of lamps is opened up in that through the control units in each case a control signal between 0 and 10 Volts, corresponding to a desired brightness, is generated, which is then transformed by a lamp operating device connected downstream of the control unit for the operation of a lamp. The configuration of the 0-10 Volt interface needed for the transformation of the control signals, is however, not described in detail.

The present invention now addresses the object of reducing the stand-by losses in an interface for a lamp operating device.

This object is achieved by means of the features of the independent claims. The dependent claims further develop the central concept of the invention in particularly advantageous manner.

SUMMARY OF THE INVENTION

In accordance with a first aspect of the invention there is thus provided an interface for a lamp operating device, which interface has at least one input-side terminal for a bus line or for connection with a button or switch. Further, there is provided an evaluation logic for processing signals present at the input-side terminal and for the generation of output-side signals for the control of the lamp operating device. An electrical isolation element electrically decouples the at least one input-side terminal from the output of the interface, at which a lamp operating device may be connected. In accordance with this aspect of the invention, the evaluation logic is arranged on that side of the electrical isolation element which is towards the input-side terminal. In other words, for example seen from the point of view of a connected bus, the evaluation logic is now before the electrical isolation element. This has quite generally the advantage that the evaluation logic, with regard to its energy supply, can be configured independently from the lamp operating device (arranged behind the electrical isolation element), so that for example the lamp operating device can be partially or completely switched off and the evaluation logic despite this can be placed in a mode which makes possible an immediate processing of signals input to the bus.

The evaluation logic may correspondingly be configured such as to at least partially (e.g. only the inverter) switch off a connected lamp operating device. In that the lamp operating device can now at least be partially switched off (and despite this it is guaranteed that incoming signals from the bus line will be immediately evaluated without the initially incoming signals not being recognized) stand-by losses in the lamp operating device can be reduced.

In particular the evaluation logic can be configured for the purpose of transmitting commands to the connected lamp operating device by means of the electrical isolation element, by means of which commands the lamp operating device is separable from the mains voltage. The lamp operating device may for example be separable from the mains by means of a relay or an optocoupler controlled triac.

The evaluation logic may thereby be configured to transmit to the connected lamp operating device, by means of the same and/or by means of a separate electrical isolation element, setting values for the connected lamp operating device. In other words, if the possibility of a complete separation from the mains is provided for the lamp operating device, the corresponding commands for this function can be transmitted via the same electrical isolation element or via a separate electrical isolation element, as the setting value commands (for example desired values for a lamp brightness control) are transmitted.

Further, the electrical isolation element can be configured also to transmit, in a bi-directional manner, signals from a connected lamp operating device to the input-side terminals and if appropriate to a bus connected thereto. Such signals are for example condition information from the connected lamp operating device, which may represent actual values or also faults.

In the idle condition, in which no signals are transmitted, there is for example present at the input-side terminals, in accordance with the DALI standard, a high level signal. In accordance with the invention, this high level signal is exploited for the energy supply of the evaluation logic. This would clearly not be possible if, as in the case of the state of the art, the evaluation logic was, seen from the bus, located behind the electrical isolation element.

Meanwhile, the invention can also be employed on systems in which in the idle condition (in which thus no signals are transmitted via the bus) a low level signal is present at the input-side terminals. In this case, the evaluation logic is so rapidly activated upon a change of the bus to a high level signal that also the first bits of the incoming digital signal can be reliably detected.

In accordance with a further aspect of the present invention there is provided an interface for a lamp operating device, such as for example an electronic ballast for a gas discharge lamp, which has an evaluation logic which is supplied with voltage by means of at least one input-side signal terminal of the interface. This terminal thus has a dual function.

In accordance with a further aspect of the invention, a lamp operating device is provided with such an interface.

Finally, the invention proposes also a method for the control of a lamp operating device by means of an interface, in which incoming signals, for example via a bus line, are initially processed, for example by means of an evaluation logic, and transformed into control signals for a lamp operating device, before they are transmitted by means of an electrical isolation element to the lamp operating device. The transformation of the incoming signals is thus effected before the transmission of the transformed commands via the electrical isolation element.

Further features advantages and characteristics of the present invention will be apparent from the now following detailed description of an exemplary embodiment and with reference to the Figs. of the accompanying drawings.

DETAILED DESCRIPTION

Figure 1:
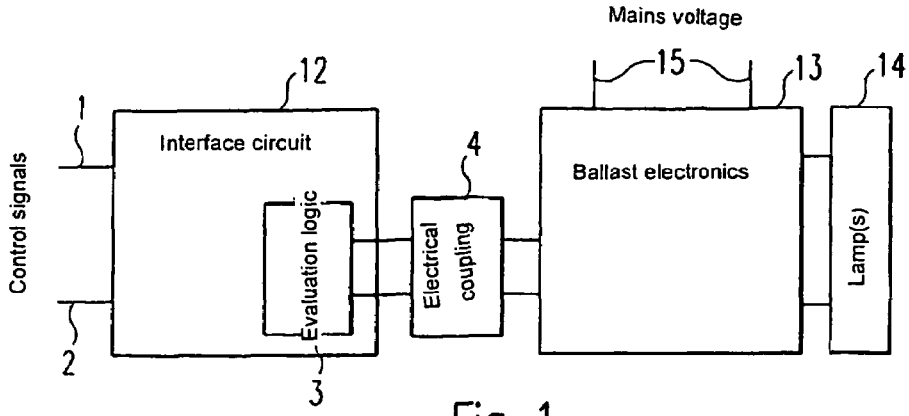
FIG. 1 shows a schematic view of an interface in accordance with the invention for a lamp operating device.

As schematically illustrated in FIG. 1, in accordance with the invention, control signals are applied at at least one input-side terminal 1, 2 of an interface circuit 12.

Even though in the exemplary embodiments there are shown two terminals 1, 2 for a bus line pair or for a button/switch, it is to be emphasized that the present invention finds application also to interfaces for the connection of a single signal line.

The control signals may for example be digital signals (for example in accordance with DALI standard) or signals from a button/switch. There is provided in the interface circuit 12 an evaluation logic 3 which transforms the control signals delivered to the input-side terminals 1, 2 into control signals for a ballast electronics 13. These already transformed control signals are transmitted from the evaluation logic 3 to the ballast electronics 13 via an electrical coupling, for example an optocoupler or a transformer, whereby the ballast electronics 13 then in turn correspondingly controls one or a plurality of lamps 14. The ballast electronics 13 is supplied with mains voltage 15 in known manner.

In contrast, in accordance with this exemplary embodiment, the evaluation logic 3 is not supplied with energy by means of the mains voltage supply 15 of the operating device (here ballast), but via the input-side terminals 1, 2 (for example bus lines). The evaluation logic 3 is thus, with regard to its voltage supply, independent of the voltage supply of the operating device.

The evaluation logic 3 in accordance with the invention is thus part of the interface 12 and no longer, as with the state of the art, part of the operating device 13.

The evaluation logic 3 may be put into effect for example as an ASIC, microcontroller or DSP.

Thereby on the one hand the case is possible that in the idle condition of the bus (for example in the case of the DALI standard), in which no signals are transmitted via the bus line, a high level signal is present at the input-side terminals 1, 2 (for example +10V), which thus provides a voltage supply for the evaluation logic 3.

If in the idle condition of the bus no voltage is present at the input-side terminals 1, 2, the evaluation logic 3 is so effected that it is immediately activated (wake-up) first upon a change of a bus line to a high level signal, by means of this voltage, wherein this activation is effected sufficiently rapidly to ensure a reliable detection of the first bits of the incoming digital signal.

Figure 2:
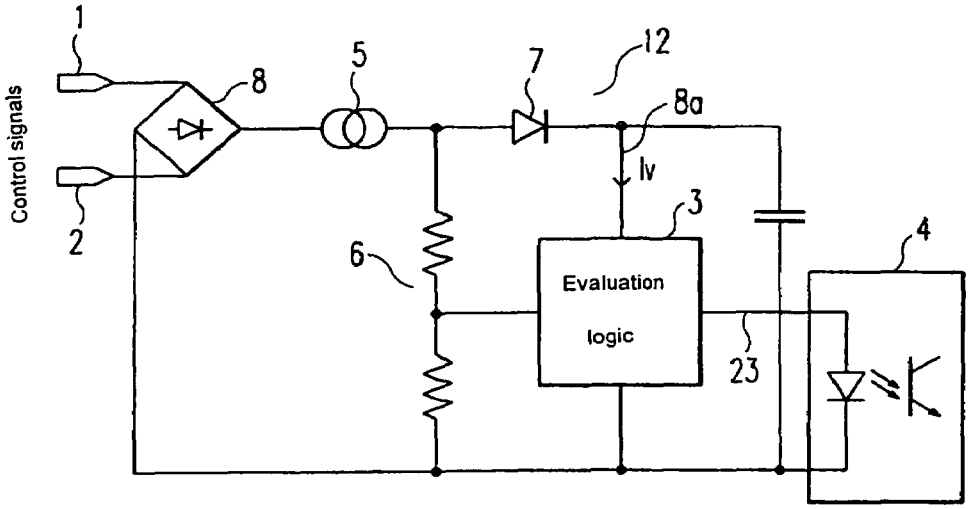
FIG. 2 shows a detail of FIG. 1, namely the interface circuit with evaluation logic and the electrical coupling for the case of a uni-directional interface.

FIG. 2 shows in a detailed view the interface circuit 12 with the evaluation logic 3 and the electrical coupling 4. The ballast electronics 13 is, in contrast, not further described in this FIG. 2 (as is also the case in FIG. 3 explained in the following).

As can be seen in FIG. 2, the control signals incoming at the input-side terminals 1 and 2 are rectified by means of a diode circuit 8.

In the case of the DALI standard, in the idle condition, as is known, a high level signal is present at the input-side terminals 1, 2 of the interface circuit 12, so that this high level signal can be employed as current supply 8 for the evaluation logic 3 by means of a constant current source 5 (impressed current) and a diode 7.

Figure 3:
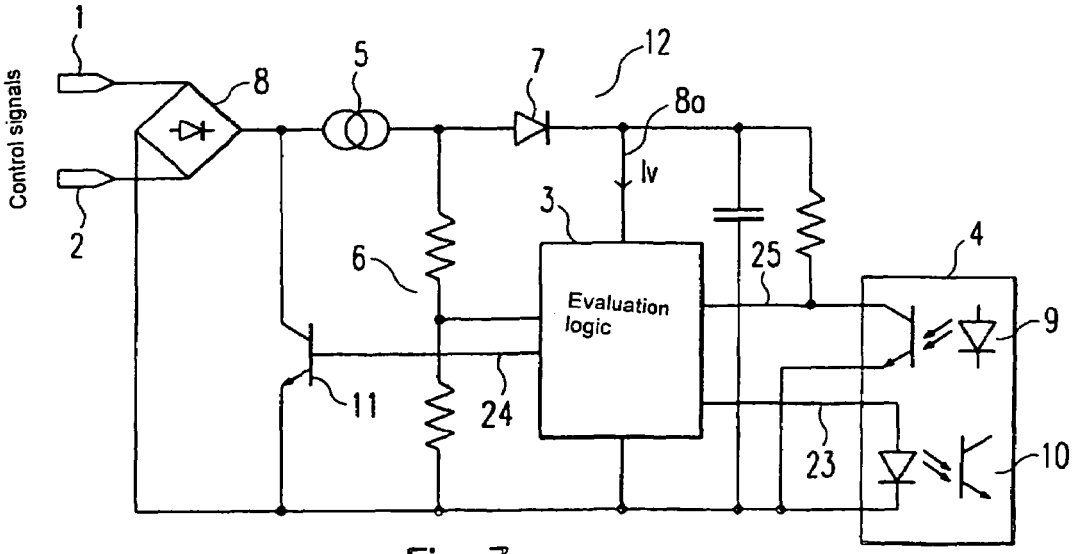
FIG. 3 shows a detailed comparable to FIG. 2, but for a bi-directional interface.

Further, the evaluation logic detects the control signals (in the case of the DALI standard for example the flanks of the digital control signals) present at the input-side terminals 1, 2 by means of a voltage divider, transforms them into control signals in accordance with logic implemented in the evaluation logic 3 and delivers these output control signals 23 to the electrical isolation element 4, which in accordance with the exemplary embodiment of FIGS. 2 and 3 is provided as an optocoupler. Meanwhile, also other electrical isolation elements, such as for example transformers etc. are conceivable.

The exemplary embodiment of FIG. 3 differs from that in accordance with FIG. 2 in that the interface 12 is constituted overall as a bi-directional interface. That is, in the electrical isolation element 4 there is provided a first branch 10 for the transmission of signals or commands to a connected operating device and a second branch 9 for return transmission of signals or commands from a connected operating device to the terminals 1, 2. Additionally to the function described in accordance with FIG. 2, in this case there are also delivered to the evaluation logic 3 input signals 25 from the electrical isolation element 4, whereby the evaluation logic 3 now transforms these signals 25 into, for example, digital bus signals 24 and controls with these output signals 24 a bus driver 11. The output signals from the bus driver 11 can then be transmitted by means of the terminals 1, 2 for example to a connected bus line.

It is thus to be noted that in accordance with the exemplary embodiments of FIGS. 2 and 3, the evaluation logic 3, seen from the input-side terminals 1, 2 of the interface 12, is arranged before the electrical isolation element 4 and thus is a real component of the interface 12. Further it is to be noted that the evaluation logic 3 is supplied with voltage not coming from the mains voltage supply 15 of the operating device 13, but coming from the signal input terminals 1, 2 of the interface 12.

Figure 4:
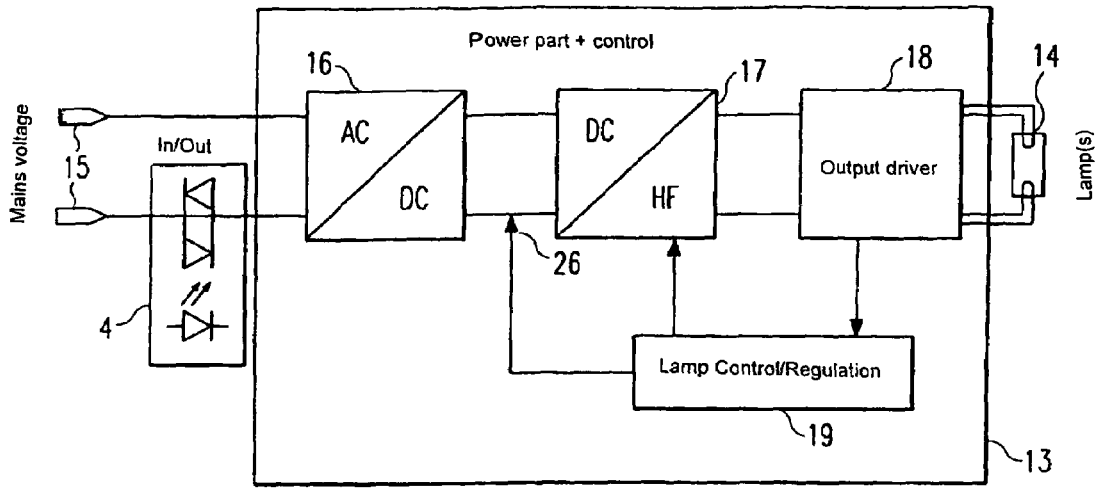
FIG. 4 shows a detail of FIG. 1, namely the electrical coupling and schematically the ballast electronics for an exemplary embodiment of the invention, in which the ballast electronics can be separated solely from the mains.
Figure 5:
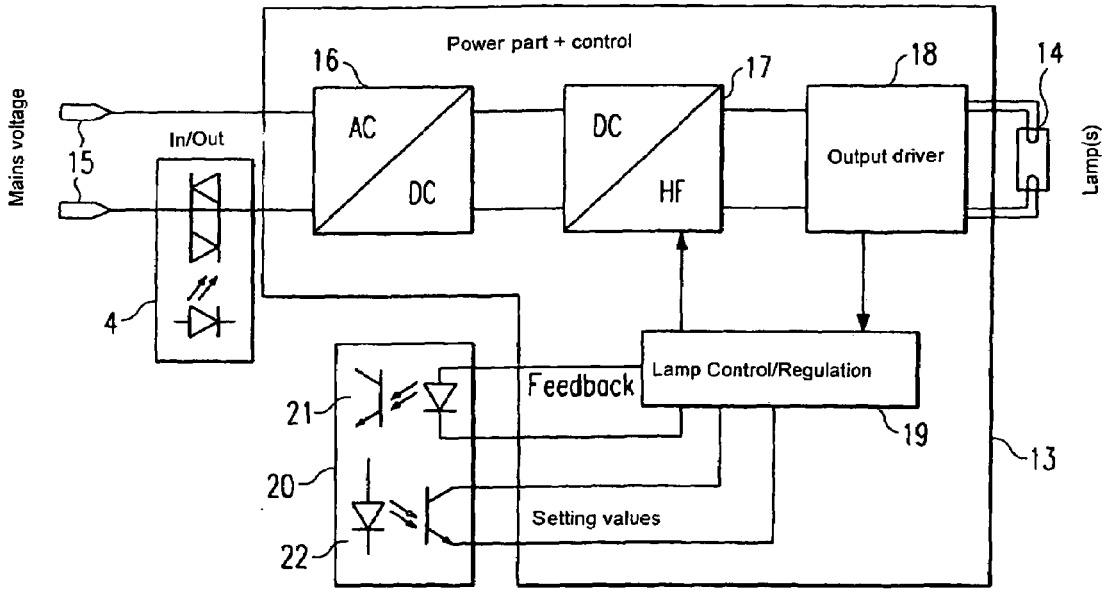
FIG. 5 shows an illustration comparable to FIG. 4, however for an exemplary embodiment with which, via an additional electrical coupling, on the one hand setting values for a lamp control/regulation and on the other hand return reports from the ballast electronics can be transmitted.
Figure 6:
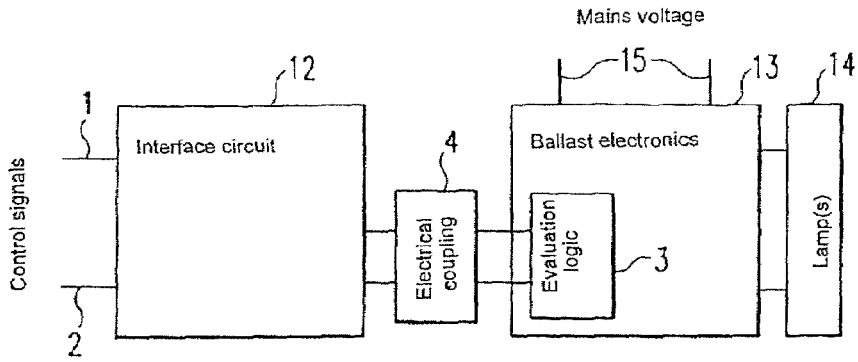
Fig. 6 PRIOR ART
FIGS. 6 and 7 show interfaces from which the present invention starts out.
Figure 7:
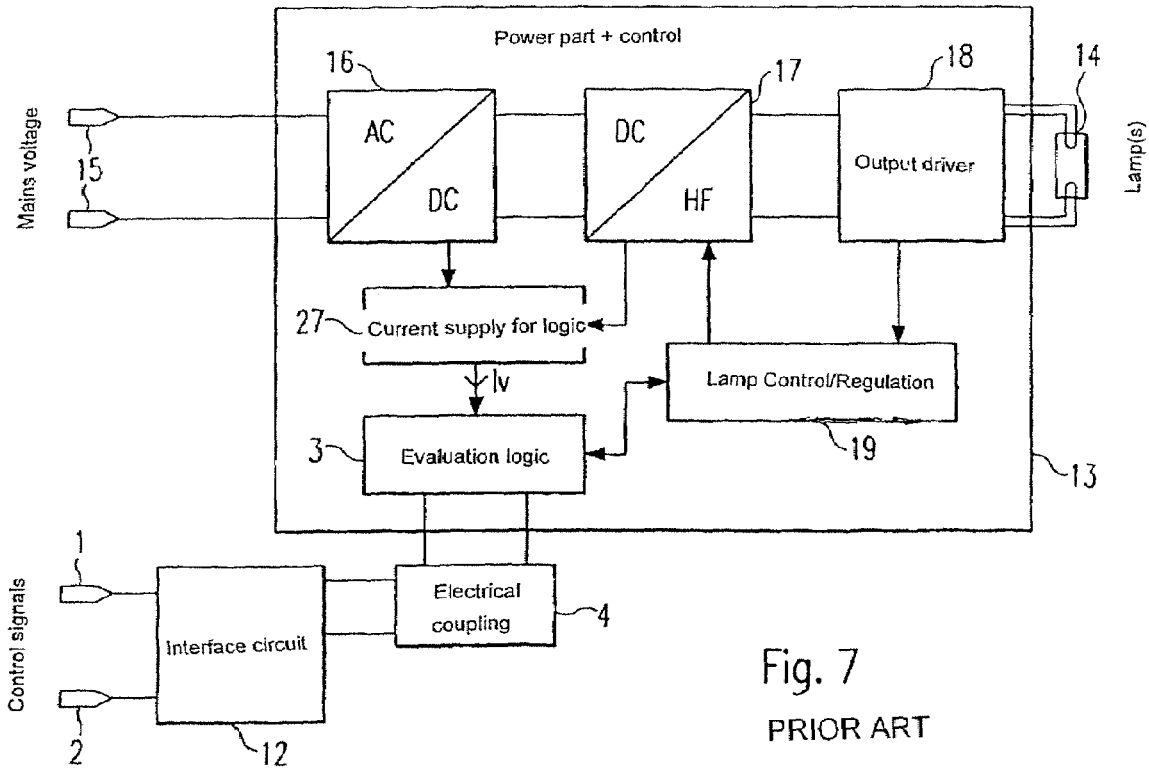
Fig. 7 PRIOR ART

With reference to FIGS. 4 and 5, there will now be described in more detail the electrical coupling 4 and the relevant sections of the ballast electronics 13. The interface 12 with the evaluation logic 3, also here of course connected to the electrical coupling 4, is in contrast not illustrated in FIGS. 4 and 5.

As can be seen in FIG. 4, the electrical coupling 4 may be formed as an optocoupler controlled triac which, depending upon the control by means of the evaluation logic 3, can separate the entire ballast electronics 13 from the mains voltage 15. In this case, in the ballast 13 there arise no losses in stand-by operation.

Of course it can also be provided that in stand-by operation only parts of the ballast 13 (for example the inverter) are switched off.

The ballast electronics 13 is only schematically indicated in FIGS. 4 and 5 and includes in particular a AC/DC converter 16, a DC/HF inverter 17 (for example a half-bridge circuit), an output driver circuit 18 and a lamp control/regulation 19, which for example detects lamp parameters (current, voltage) and in dependence upon this detection indicates the desired value for the high frequency and/or the DC bus voltage (intermediate circuit voltage) 26 in accordance with a regulation algorithm and for example correspondingly sets the switching frequency of the inverter 17.

The exemplary embodiment in accordance with FIG. 5 is, in comparison with that of FIG. 4, expanded in that the evaluation logic 3 (as is known, not illustrated in FIGS. 4 and 5) not only controls an electrical isolation element 4 for the switching on and switching off of the mains voltage 15 for the ballast electronics 13, but beyond this passes on setting values (for example desired values) for the lamp control or regulation 19 and other signals, via the same or, as illustrated in FIG. 5, via a separate electrical isolation element 20.

Beyond this, or alternatively, the electrical isolation element 20, in the exemplary embodiment an optocoupler, may be configured to be bi-directional and along with the first transmission branch 22 for the setting values also have a feedback branch 21 in order to transmit condition information and/or fault reports from the lamp control/regulation 19 or other components of the ballast electronics 13 via the branch 21 of the electrical isolation element 20 to the evaluation logic 3, so that this can then issue appropriate digital signals (24 in accordance with FIG. 3) to the terminals 1, 2 of the interface 12.

The invention claimed is:

1. Interface for a lamp operating device comprising, at least one input-side terminal for the connection of bus lines or for connection with a button or switch, an evaluation logic for the processing of signals present at the input-side terminal and for the generation of output-side signals for the control of the lamp operating device, and at least one electrical isolation element adapted to electrically decouple the input-side terminal from the lamp operating device, wherein the evaluation logic is arranged on a side of the electrical isolation element towards the at least one input-side terminal, and wherein the evaluation logic is supplied with voltage by the at least one input-side signal terminal.

2. Interface according to claim 1, wherein, the evaluation logic is configured to at least partially switch off a connected lamp operating device.

3. Interface according to claim 2, wherein, the evaluation logic is configured to transmit by means of the electrical isolation element signals or commands to the connected lamp operating device so that the lamp operating device is separable from a mains voltage.

4. Interface according to claim 2, wherein, the lamp operating device is separable from a mains voltage by means of a relay or an optocoupler controlled triac.

5. Interface according to claim 1, wherein, the evaluation logic is configured to transmit setting values to a connected lamp operating device utilizing a separate electrical isolation element.

6. Interface according to claim 1, wherein, the electrical isolation element is configured also to transmit, in bi-directional manner, signals from a connected lamp operating device to the input-side terminals and, if applicable, to a bus connected thereto.

7. Interface according to claim 1, wherein, in an idle condition, in which no signals are transmitted, a high level signal is present at the input-side terminals, which signal supplies the evaluation logic with energy.

8. Interface according to claim 1, wherein, in an idle condition, in which no signals are transmitted, there is present at the input-side terminals a low level signal, and the evaluation logic can be activated by means of a change to a high level signal.

9. Interface for a lamp operating device, comprising, at least one input-side signal terminal for the connection of a bus line or for connection with a button or switch, and an evaluation logic for the processing of signals present at the at least one input-side terminal and for the generation of output-side signals for the control of the lamp operating device wherein, the evaluation logic has a voltage supply independent of a mains voltage supply of the lamp operating device.

10. Interface according to claim 9, wherein, the evaluation logic is supplied with voltage by means of the at least one input-side signal terminal.

11. A ballast for a fluorescent tube, having an interface in accordance with claim 1.

12. Method for the control of a lamp operating device via an interface, comprising the following steps:

application of bus signals or button/switch signals to at least one input-side terminal of the interface, processing of signals present at the input-side terminal and generation of output-side signals for the control of the lamp operating device, and thereupon transmission of the processed control signals by means of an electrical isolation element to the lamp operating device, wherein, a voltage supply for the processing of the signals present at the input-side terminal and for the generation of the output-side signals for the control of the lamp operating device is effected via the at least one input-side signal terminal.

13. Method according to claim 12, wherein, by means of the electrical isolation element signals or commands are transmitted to the connected lamp operating device, so that the lamp operating device is separated from a mains voltage.

14. Method according to claim 13, wherein, the lamp operating device is separated from a mains voltage by means of a relay or an optocoupler controlled triac.

15. Method according to claim 12, wherein, by means of the electrical isolation element setting values are transmitted to the connected lamp operating device.

16. Method according to claim 12, wherein, signals are transmitted from a connected lamp operating device to the input-side terminals and, if applicable, to a bus connected thereto.

17. Method according to claim 12, wherein, in an idle condition, in which no signals are transmitted, a high level signal is present at the input-side terminals, which signal supplies the evaluation logic with energy.

18. Method according to claim 12, wherein, in an idle condition, in which no signals are transmitted, a low level signal is present at the input-side terminals and the evaluation logic is activated by means of a change to a high level signal.

* * * * *